United States Patent [19]

Leroy et al.

[11] 4,031,588

[45] June 28, 1977

[54] BROOM

[75] Inventors: Henri Joseph Marie Adrien Leroy, Le-Pre-Saint-Gervais; Christian Ludovic Leroy, Perpignan, both of France

[73] Assignee: Henri Joseph Marie Andrien Leroy, Le-Pre-Saint-Gervais, France

[22] Filed: Sept. 15, 1976

[21] Appl. No.: 723,469

[30] Foreign Application Priority Data

Oct. 21, 1975 France ..... 75.32093

[52] U.S. Cl. ..... 15/171; 15/202; 15/225; 15/159 A; 300/21

[51] Int. Cl.[2] ..... A46B 3/18

[58] Field of Search ..... 15/168–175, 15/225, 226, 160, 159 A, 202; 300/21

[56] References Cited

UNITED STATES PATENTS

| | | | |
|---|---|---|---|
| 866,784 | 9/1907 | Glorieux et al. | 15/225 X |
| 3,416,179 | 12/1968 | Wiese | 15/171 |
| 3,533,123 | 10/1970 | Brunello | 15/171 |

FOREIGN PATENTS OR APPLICATIONS

| | | | |
|---|---|---|---|
| 62,310 | 1/1955 | France | 15/225 |

*Primary Examiner*—Peter Feldman

[57] ABSTRACT

The invention relates to a broom comprising a bundle of plastics stems wound around a hollow bar for the broom handle. The winding of the plastics stems is ensured by a binding strip co-operating with opposite crenels of the stems serving as a fixing point for the strip and as a passageway for the spirals of the strip to absorb its thickness.

9 Claims, 10 Drawing Figures

BROOM

The present invention has essentially for its object an improved broom of plastics material constituted by a bundle of stems wound on an axial tube or hollow bar reserved for the fixing of the broom handle, the upper portion of the said bundle being inserted in a protective sleeve, the said hollow bar, bundle of stems and protective sleeve constituting with the broom handle an either dismountable or non-dismountable assembly.

Brooms are already known which are composed of a plurality of birch twigs tightened around a handle. Such brooms are generally used for street sweeping. However, they are frangible, liable to wear out rapidly and require frequent replacement of the bundle of twigs.

The improved broom according to the present invention is intended to remedy the aforementioned drawbacks. It is of elaborate design and at the same time extremely simple and inexpensive.

More specifically, the broom according to the invention is of the type constituted by a bundle of stems of plastics material wound on a hollow bar reserved for the broom handle, the upper portion of the said bundle being inserted in a protective sleeve, the said hollow bar, bundle of stems and sleeve constituting with the broom handle an either dismountable or non-dismountable assembly, and is characterized in that the winding of the stems is ensured by a separate binding strip of appropriate length, of plastics or any other material, co-operating with two mutually opposite crenels, indentations or notches provided in the thickness of the stems, one of the said crenels serving as a fixing or fastening point for the said strip and the other crenel serving as a passageway for the strip spirals or turns in order to absorb or compensate for their thickness after the winding.

The above-described means advantageously allow the stems to be securely locked or held while at the same time allowing for a more reliable assembling of the broom parts.

According to another feature of the invention, the said binding strip is provided with spaced perforations, the spacing between which depends upon the number of stems to be accomodated, and is held by tongues, pins or like projections provided on the crenels.

It should be observed that the binding strip is firmly secured to or integral with the crenels, e.g. by being riveted or welded thereto.

According to another feature of the invention, the lower edge of two successive crenels is bevelled in order to facilitate the slipping of the bundle of stems into the protective sleeve.

According to still another feature of the invention, the aforesaid hollow bar is provided with a collar including a plurality of circular grooves, whereas the lower portion of the said bar is provided with ribs forming a constriction which ensures the locking of the handle.

Furthermore, the hollow bar is split through the whole of its length, the said split forming at its lower portion a broken line.

According to another feature of the invention, the protective sleeve is provided with an internal annular shoulder which is bevelled in order to facilitate the slipping of the bundle of stems into the said sleeve, whereas a cover or cap whose bottom is provided with a collar or the like is mounted on an external annular shoulder provided at the upper portion of the said sleeve.

According to still another feature of the invention, at least one slidable ring is provided around the bundle of stems which are provided with tongues, pins or like projections for holding the said ring in the desired position, the latter being adapted to remain in stand-by position at the upper portion of the bundle or on the said protective sleeve.

Other features, purposes and advantages of the invention will appear more clearly from the following detailed description made with reference to the appended drawings given solely by way of example and wherein.

Figures 1, 2, 3, 4, 5, 6:
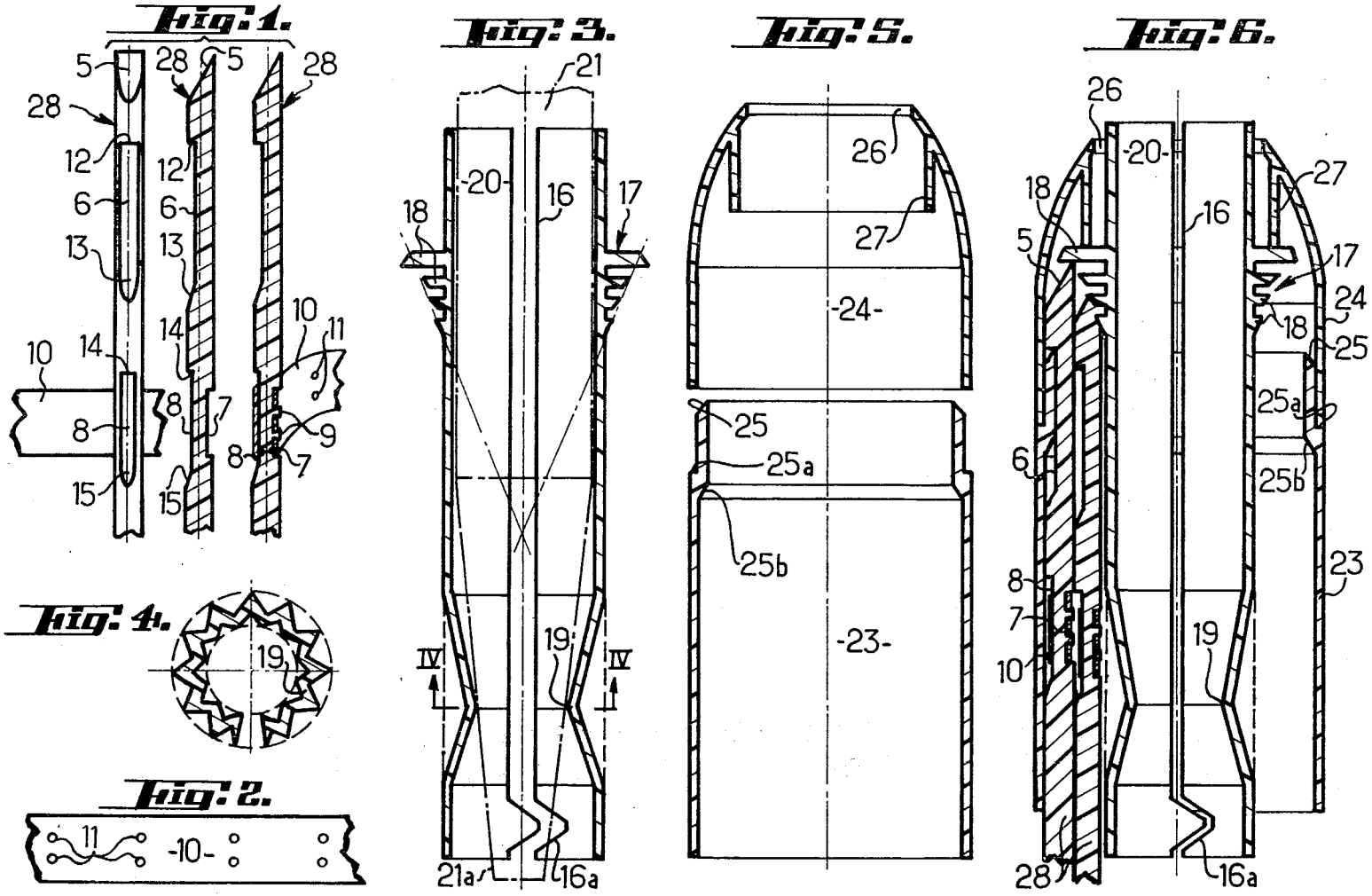
FIG. 1 is a partial elevational view of a stem of plastics material of the broom according to the invention, the said stem being shown frontwise and in longitudinal section.
FIG. 2 is a partial view of the binding strip laid flat.
FIG. 3 is an axial sectional view of the hollow bar.
FIG. 4 is a sectional view upon the line IV—IV of FIG. 3.
FIG. 5 is an axial sectional view of the sleeve and its associated cover.
FIG. 6 is an axial sectional view of the sleeve, the cover and the hollow bar in the assembled position, with the stems held therein.
Figure 7:
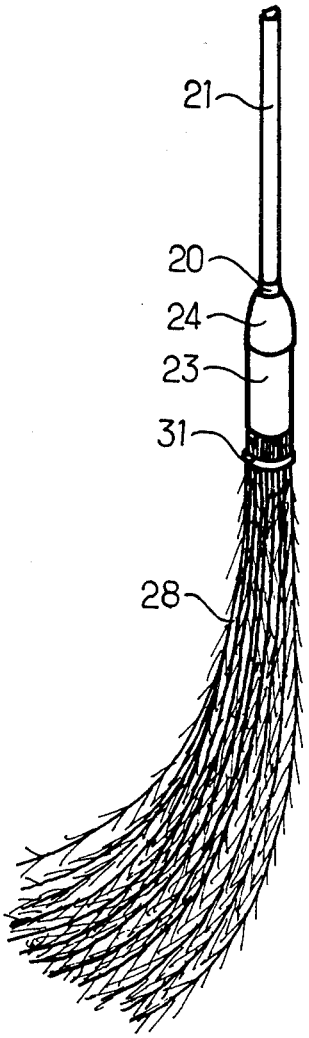
FIG. 7 is a perspective view of the broom according to the invention.
Figure 8:
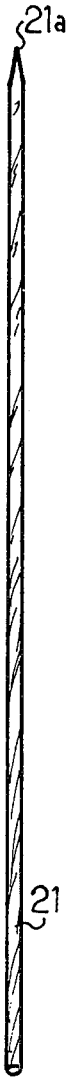
FIG. 8 is an elevational view of the broom handle provided with a pointed end.

According to one form of embodiment and referring to the appended drawings, a broom according to the invention comprises essentially a plurality of stems 28 of plastics material, assembled together by a binding strip 10 (FIG. 2) and wound around a hollow bar or tubular member 20 (FIG. 3). Around the stems 28 thus wound on the hollow bar 20 is mounted a protective sleeve 23 on which is fitted a cap or cover 24. A handle 21 is tightly or forcedly introduced into the hollow bar 20 so as to finally constitute the broom which is seen in FIG. 7.

Reference is now made to the appended drawings for a detailed description of the above essential elements.

Referring to FIG. 1, it is seen that the stems 28 of plastics material having a suitably shaped, e.g. U-shaped, cross-section, comprise a skewed upper end 5, a crenel, indentation or notch 6 and two mutually opposite crenels, indentations or notches 7 and 8. The crenels 6 and 8 are each provided with a right-angled wall 12 and 14, respectively. The wall 12 serves as a hooking means for retaining the stems 28 on the peripheral edge 25 of the sleeve 23. The binding strip 10, of a suitable supple or flexible material such as for example a metal is used to assemble the stems 28 together and is fastened in the crenel 7 of the stems 28. The strip 10 may be fastened by any suitable means, e.g. by riveting or welding. In the form of embodiment illustrated in FIG. 1, the crenel 7 is provided with tongues, pins or like projections 9 adapted to penetrate into the perforations 11 provided in the strip 10. Thereafter, the said projections may be for example press-flattened. The crenels 8 advantageously allow the thickness of the binding strip 10 to be advantageously absorbed or compensated for during the winding of the stems 28 round the hollow bar 20. The crenels 6 and 8 are provided with bevelled portions 13 and 15, respectively, for the purpose of facilitating the slipping of the sleeve 23 and its fitting onto the whole set of stems 28 wound round the tube 20.

As seen more clearly in FIG. 3, this tube is split along a line 16 which preferably forms a broken line at the lower portion of the tube, as shown at 16*a*. The split 16 advantageously imparts to the bar 20 a certain radial elasticity allowing the handle 21 to be inserted forcedly or tightly, as seen clearly in FIG. 3, as compared with FIG. 6 where the gap formed by the split is obviously smaller than when the handle 21 is introduced into the bar 20. At 17 is shown a collar including a plurality of circular grooves 18. This collar has a cone-shaped general configuration so as to drive back the upper ends of the stems 28 outwardly in order to facilitate the hooking and locking of the portions 12 of the crenels 6 on the edge 25 of the protective sleeve 23. As shown at 19 in FIGS. 3 and 4, ribs or the like are provided so as to form a constriction or jaw ensuring the locking of the pointed end 21*a* of the handle 21.

It is seen in FIG. 5 that the protective sleeve 23 is provides with an annular shoulder 25*a* to receive the cover 24, e.g. by screwing or snap-in fitting, and another substantially conical internal shoulder 25*b* so as to allow the skewed upper portion 5 of the stems 28 to slide during the fitting of the sleeve onto the bundle of stems. As appears clearly from FIG. 5, the cover 24 is of course provided with a passage orifice 26 for the handle 21 and with a specially designed bottom, for example a collar 27, allowing a pressure to be exerted on the collar 17 of the hollow bar 20, as seen in FIG. 6.

The latter Figure clearly shows how the sleeve 23, the cover 24, the tubular bar 20 and the stems 28 co-operate to ensure secure and reliable fitting of the latter while at the same time allowing the handle 21 to be inserted tightly. Besides, the inserted handle will strengthen the whole assembly.

Figure 9:
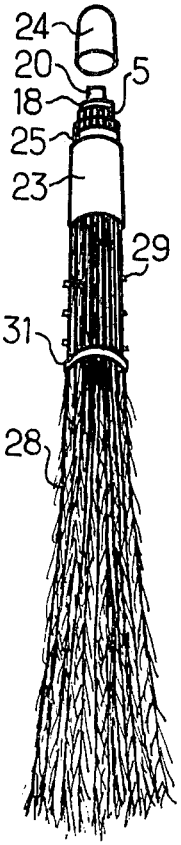
FIG. 9 is a perspective view of the broom with its sleeve and cover removed.
Figure 10:
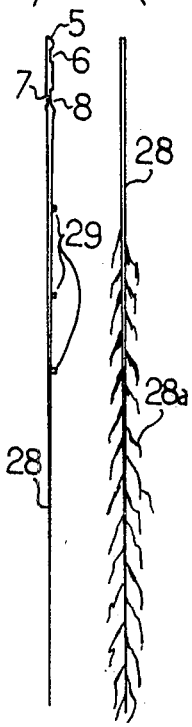
FIG. 10 is another front and profile view of a stem.

In FIGS. 7 and 9 is shown a ring 31 sliding round a bundle of stems 28 and allowing the diameter and therefore the rigidity of the bundle to be adjusted at will. Tongues, pins or like projections 29 are provided on the stems 28 to retain the ring in the desired position.

The plastics stems 28 may also be provided with twig-like blanchlets or the like 28*a* so as to increase the density of the bundle of stems.

The assembling of the broom of the invention just described is readily inferred from the foregoing description.

The stems 28 laid flat are joined together by means of the strip 10 so as to obtain a series of assembled stems. Thereafter, the strip with the stems thus assembled is wound around the hollow bar 20. The protective sleeve 23 is then fitted onto the bundle of stems. Thereafter, the cover 24 is placed on the sleeve 23. Lastly, the handle 21 is forcedly inserted into the tubular bar 20.

The broom according to the invention is therefore particularly simple and strong owing to the co-operation of the elements just described. Moreover, the broom according to the invention allows efficient sweeping to be performed even under very difficult conditions, e..g. under stationary or parked cars.

Of course, the inventions is by no means limited to the form of embodiment described and illustrated, which has been given by way of example only. In particular, it comprises all the means constituting technical equivalents to the means described as well as their combinations, should the latter be carried out according to the spirit of the invention and within the scope of the following claims.

What is claimed is:

1. A broom constituted by a bundle of stems wound around a hollow or tubular bar reserved for the broom handle, the upper portion of the said bundle being fitted into a protective sleeve, the said hollow bar, bundle of stems and protective sleeve constituting with the broom handle on either dismountable or non-dismountable assembly, wherein the winding of the stems is ensured by a separate binding strip of appropriate length of flexible material co-operating with mutually opposite crenels, indentations or notches provided in the thickness of the stems, one of the said crenels serving as a fixing point for the strip and the other crenel serving as a passageway for the spirals or turns of the said strip so as to absorb or compensate for its thickness after the winding.

2. A broom according to claim 1, wherein the said binding strip is provided with spaced perforations, the spacing between which depends upon the number of stems it is intended to receive, and is held by tongues, pins or like projections provided on the crenels.

3. A broom according to claim 2, wherein the binding strip is secured to or integral with the crenels, for example by riveting or welding.

4. A broom according to claim 1, wherein the lower wall of two successive crenels is bevelled to facilitate the slipping of the bundle of stems into the protective sleeve.

5. A broom according to claim 1, wherein the said hollow or tubular bar is provided with a collar including a plurality of circular grooves, whereas the lower portion of the said bar is provided with ribs or the like forming a constriction to ensure the locking of the broom handle.

6. A broom according to claim 5, wherein the hollow or tubular bar is split through its whole length, the said split preferably forming at its lower portion a broken line.

7. A broom according to claim 1, wherein said protective sleeve is provided with an internal annular shoulder which is bevelled to facilitate the slipping of the bundle of stems into the said sleeve, whereas a cover or cap whose bottom is provided with a collar or the like is mounted on an external annular shoulder provided on the said sleeve.

8. A broom according to claim 1, wherein at least one sliding ring is provided round the bundle of stems which are provided with tongues, pins or like projections forming stop means for holding the said ring in the desired position.

9. A broom according to claim 1, wherein the said hollow or tubular bar receives a handle.

* * * * *